US009127473B1

(12) United States Patent
Scipio

(10) Patent No.: US 9,127,473 B1
(45) Date of Patent: Sep. 8, 2015

(54) HOME ENTERTAINMENT STAGE

(71) Applicant: Darrel Scipio, New Orleans, LA (US)

(72) Inventor: Darrel Scipio, New Orleans, LA (US)

( * ) Notice: Subject to any disclaimer, the term of this patent is extended or adjusted under 35 U.S.C. 154(b) by 0 days.

(21) Appl. No.: 14/525,618

(22) Filed: Oct. 28, 2014

(51) Int. Cl.

| | |
|---|---|
| ***E04H 3/24*** | (2006.01) |
| ***E04H 3/28*** | (2006.01) |
| ***A63J 1/00*** | (2006.01) |
| *E04G 1/24* | (2006.01) |

(52) U.S. Cl.
CPC ... *E04H 3/24* (2013.01); *A63J 1/00* (2013.01); *E04H 3/28* (2013.01); *E04G 1/24* (2013.01); *G10H 2220/135* (2013.01)

(58) Field of Classification Search
CPC ..... E04H 3/22; E04H 3/24; E04H 3/26; E04H 3/28; A63F 2300/308; A63F 2300/8047; E04G 1/15; E04G 1/24; E04G 5/02; G10H 2220/135; A63J 1/00
USPC ..... 52/6, 7; 472/75; 182/222, 223
See application file for complete search history.

(56) References Cited

U.S. PATENT DOCUMENTS

| | | | | |
|---|---|---|---|---|
| 3,021,575 | A * | 2/1962 | Heisler | 108/167 |
| 3,091,816 | A * | 6/1963 | Wetzel | 108/172 |
| 3,747,708 | A * | 7/1973 | Wenger et al. | 182/152 |
| 4,122,761 | A * | 10/1978 | Westin et al. | 454/118 |
| 4,169,335 | A | 10/1979 | Betancourt | |
| 4,481,870 | A * | 11/1984 | Smith | 454/88 |
| 4,695,903 | A * | 9/1987 | Serap et al. | 386/359 |
| 4,857,028 | A * | 8/1989 | Pail | 446/82 |
| 4,934,113 | A * | 6/1990 | Hall et al. | 52/7 |
| 5,078,442 | A | 1/1992 | Rau | |
| D326,690 | S | 6/1992 | Hamzik | |
| 5,152,109 | A * | 10/1992 | Boers | 52/143 |
| 5,343,817 | A * | 9/1994 | Abraham et al. | 108/97 |
| 5,634,309 | A * | 6/1997 | Polen | 52/392 |
| 5,651,405 | A * | 7/1997 | Boeddeker et al. | 160/135 |
| 5,765,314 | A | 6/1998 | Giglio | |
| 6,386,985 | B1 * | 5/2002 | Rackham | 472/75 |
| 6,393,769 | B1 * | 5/2002 | Mertik et al. | 52/7 |
| 6,514,083 | B1 | 2/2003 | Kumar | |
| 6,581,544 | B1 * | 6/2003 | Smith | 119/401 |
| 8,393,116 | B2 * | 3/2013 | Reeve et al. | 52/6 |
| 8,567,811 | B1 * | 10/2013 | Jones | 280/656 |
| 2006/0096445 | A1 | 5/2006 | Leach | |
| 2006/0150530 | A1 | 7/2006 | Davey | |
| 2009/0104956 | A1 * | 4/2009 | Kay et al. | 463/7 |
| 2010/0009750 | A1 * | 1/2010 | Egozy et al. | 463/35 |
| 2011/0111846 | A1 * | 5/2011 | Ciarrocchi | 463/30 |
| 2013/0101343 | A1 * | 4/2013 | Chase et al. | 403/322.4 |
| 2013/0319796 | A1 * | 12/2013 | Davis | 182/222 |
| 2013/0333302 | A1 * | 12/2013 | Valente et al. | 52/7 |

(Continued)

FOREIGN PATENT DOCUMENTS

| | | |
|---|---|---|
| CN | 2139467 | 8/1993 |

*Primary Examiner* — Joshua J Michener
*Assistant Examiner* — Matthew Gitlin
(74) *Attorney, Agent, or Firm* — Kyle A. Fletcher, Esq.

(57) ABSTRACT

The home entertainment stage includes a raised surface defining a miniature stage. The raised surface includes a plurality of fixtures integrated therein, which include lights, microphones and microphone stands as well as a fan. The home entertainment stage includes side surfaces, which may include audio/video controls, speakers, switches, lights, wheels, and a handle. The home entertainment stage has a size and shape comparable to a large coffee table, and is able to lie on a ground surface, or be turned to a side wherein the wheels enable the home entertainment stage to be rolled away when not in use.

15 Claims, 4 Drawing Sheets

(56) References Cited

U.S. PATENT DOCUMENTS

2014/0026514 A1* 1/2014 Davis et al. ..... 52/645
2014/0260025 A1* 9/2014 Nieminski ..... 52/302.1
2014/0325925 A1* 11/2014 Amar et al. ..... 52/220.1
2014/0360104 A1* 12/2014 Jannotti Newlands ..... 52/7

* cited by examiner

HOME ENTERTAINMENT STAGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of miniature stages, more specifically, a miniature stage that is specially suited for use in a living room or a particular room of a home.

SUMMARY OF THE INVENTION

An embodiment of the disclosure meets the needs presented above by generally comprising a raised surface defining a miniature stage. The raised surface includes a plurality of fixtures integrated therein, which include lights, microphones and microphone stands as well as a blower. The home entertainment stage includes side surfaces, which may include audio/video controls, speakers, switches, lights, wheels, and a handle. The home entertainment stage has a size and shape comparable to a large coffee table, and is able to lie on a ground surface, or be turned to a side wherein the wheels enable the home entertainment stage to be rolled away when not in use.

These together with additional objects, features and advantages of the home entertainment stage will be readily apparent to those of ordinary skill in the art upon reading the following detailed description of presently preferred, but nonetheless illustrative, embodiments of the home entertainment stage when taken in conjunction with the accompanying drawings.

In this respect, before explaining the current embodiments of the home entertainment stage in detail, it is to be understood that the home entertainment stage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the home entertainment stage.

It is therefore important that the claims be regarded as including such equivalent construction insofar as they do not depart from the spirit and scope of the home entertainment stage. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
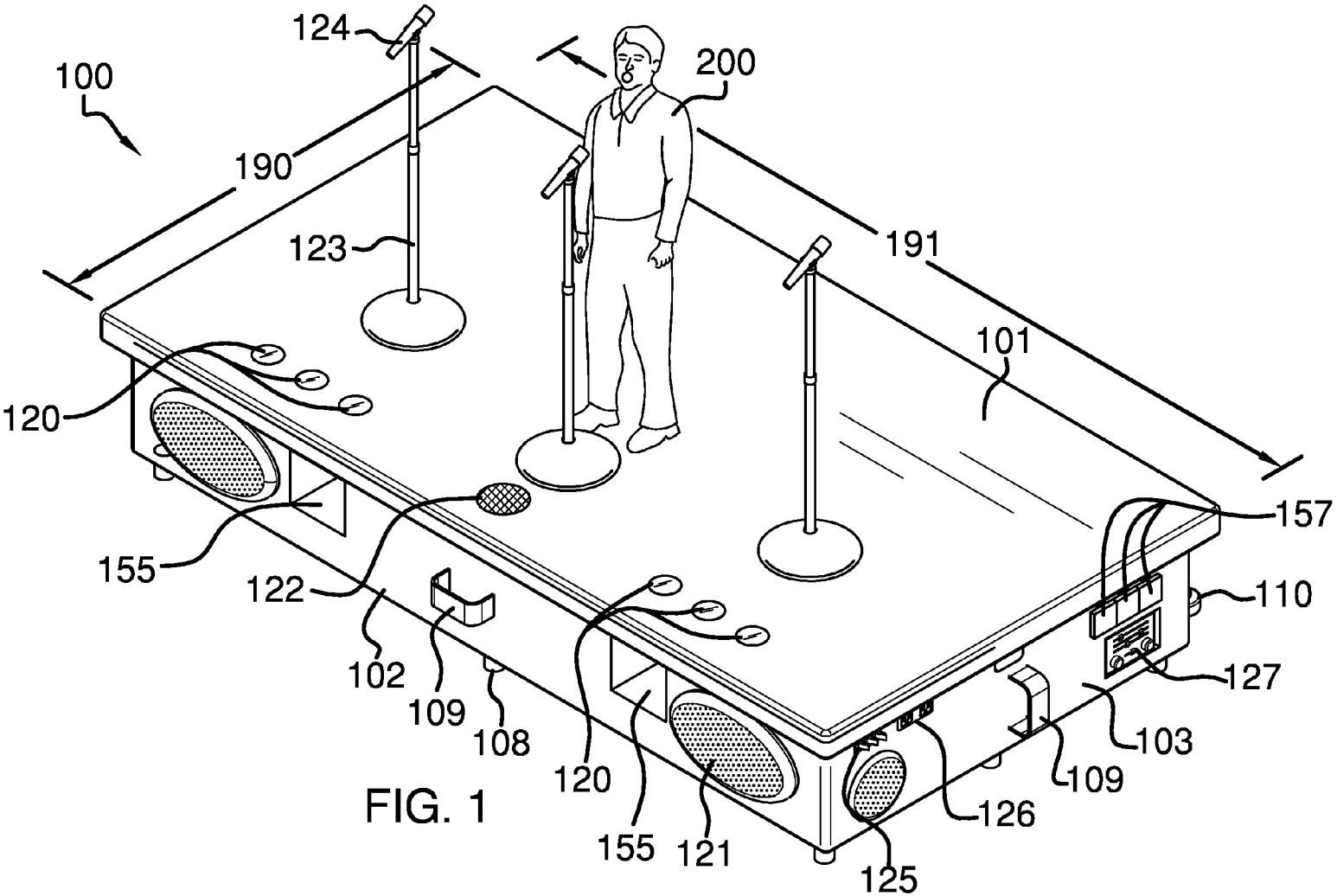
FIG. 1 is a front, perspective view of an embodiment of the disclosure.
Figure 2:
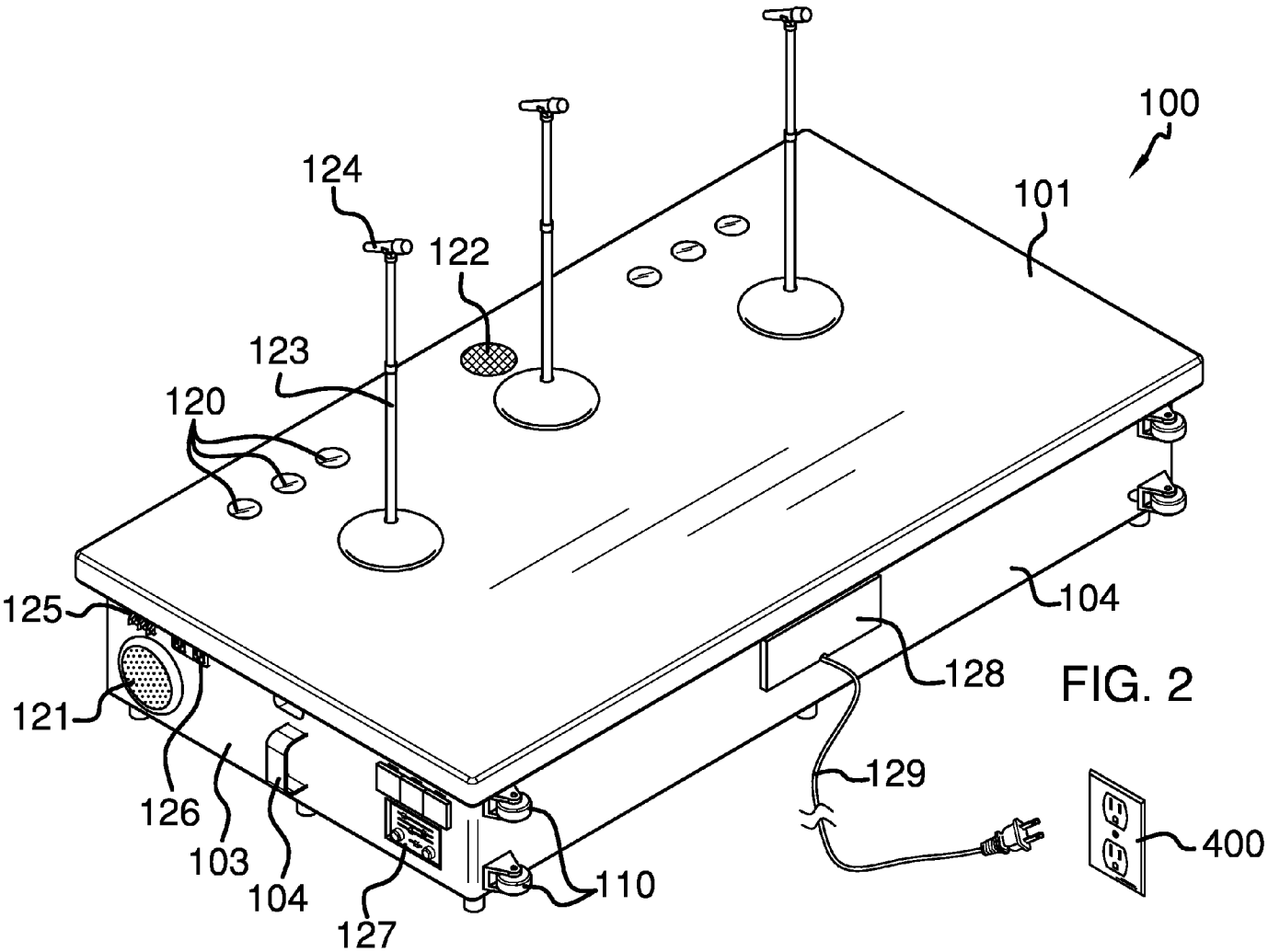
FIG. 2 is a rear, perspective view of an embodiment of the disclosure.
Figure 3:
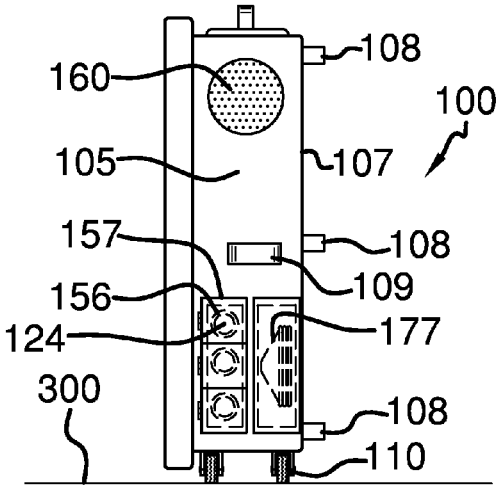
FIG. 3 is a view of an embodiment of the disclosure turned on a side in order to be rolled via the wheels.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the home entertainment stage 100 (hereinafter invention) generally comprises a top surface 101, a first side surface 102, a second side surface 103, a third side surface 104, and a fourth side surface 105. The top surface 101 is generally rectangular in shape, and is generally of enough surface area for at least one person 200 to stand thereon. It shall be noted that the person 200 may be of any age.

The first side surface 102, the second side surface 103, the third side surface 104, and the fourth side surface 105 all have a side height 106, which is no less than 3 inches, but not more than 2 feet. The top surface 101 is further defined with a top surface width 190, which is not less than 2 feet, but not more than 6 feet. The top surface 101 is further defined with a top surface length 191, which is not less than 4 feet, but not more than 10 feet.

The invention 100 includes a bottom surface 107 that includes a plurality of feet member 108 thereon. The invention 100 is placed on a ground surface 300 when in use. The feet member 108 interface between the ground surface 300 and the bottom surface 107.

The second side surface 103, the first side surface 102, and the fourth side surface 105 each include a handle member 109; whereas, the third surface 104 includes a plurality of wheels 110 thereon. The plurality of wheels 110 may be caster wheels. The handle members 109 and the plurality of wheels 110 enable the invention 100 to be turned 90 degrees over to the side in order to wheel the invention 100 away when not in use.

Figure 4:
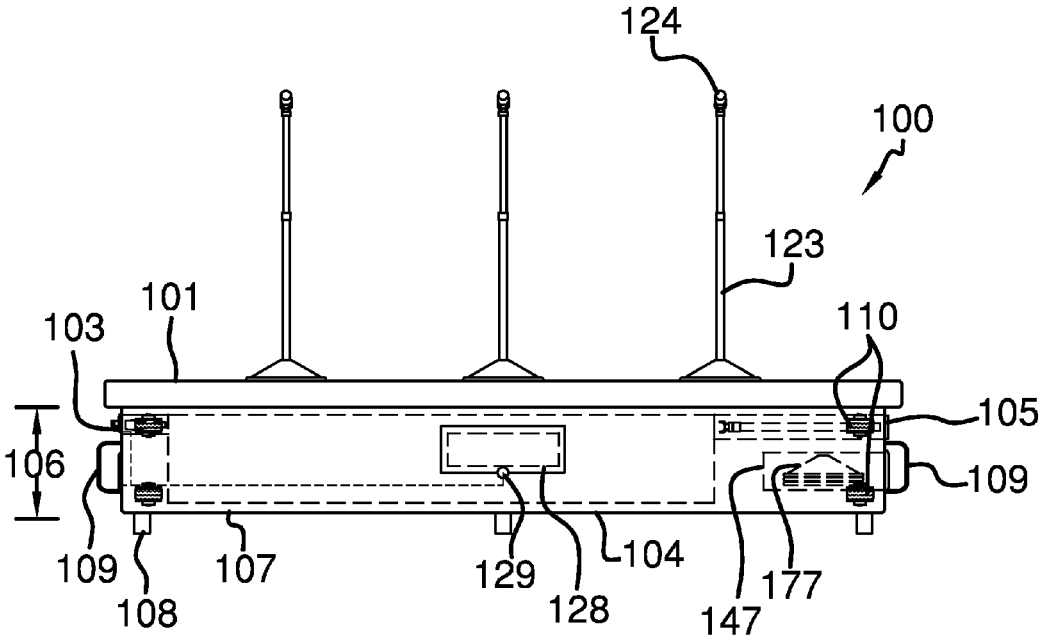
FIG. 4 is a rear view of an embodiment of the disclosure.

The top surface 101, the first side surface 102, the second side surface 103, the third side surface 104, the fourth side surface 105, and the bottom surface 107 form an interior space 111 (see FIG. 4). The interior space 111 accommodates a plurality of components associated with the use of the invention 100. The interior space 111 accommodates wiring that is needed to connect a plurality of components that are listed below.

The invention 100 includes a plurality of light members 120, a plurality of speakers 121, a blower 122, a plurality of microphone stands 123 and a plurality of microphones 124. The light members 120 are provided on the top surface 101. The plurality of speakers 121 are located on the first side surface 102, the second side surface 103, and the fourth side surface 105. The blower 122 is located on the top surface 101 in order to provide moving air for the person 200 standing thereon. The plurality of microphone stands 123 and the respective microphones 124 are placed onto the top surface 101.

Located on the first side surface 102, is at least one light access 155. The at least one light access 115 is essentially an opening on the first side surface 102 such that the plurality of light members 120 are accessible from underneath the top surface 101. It is well known in the art unit of lighting that a light bulb may be accessed from behind.

Located on the second side surface 103 is a plurality of microphone storage units 156. The microphone storage units 156 each enable one of the plurality of microphones 124 to be safely stored therein. The plurality of microphone storage units 156 each include a microphone storage unit cover 157 that secured Located on the second side surface 103 is a plurality of light switches 125, electrical outlets 126, and audio controls 127. The audio controls 127 control the output of the speakers 121, and are in wireless communication with the microphones 124. The light switches 125 control the plurality of light members 120. The third side surface 104 includes a cord storage cover 128 that when removed provides access to a main electrical cord 129 that is responsible for providing all electrical power to the invention 100 via a standard electrical outlet 400. The main electrical cord 129 connects to the plurality of lights switches 125, the electrical outlets 126, and the audio controls 127 (see FIG. 4). In use, the invention 100 is able to provide a miniature stage for the person 200 to perform from. When not in use, the invention 100 is able to be rotated 90 degrees in order to be turned onto the side whereby the wheels 110 rest on the ground surface 300.

Referring to FIG. 4, a microphone base storage compartment 147 is provided on the third side surface 104. The plurality of microphone stands 123 is each able to be disassembled into a respective microphone stand base 177 and a microphone stand pole 178. The microphone stand base 177 is able to be stored inside of the microphone base storage compartment 147. A microphone stand pole compartment 148 is also included, and is responsible for storing the plurality of microphone stand poles 178 therein.

Figure 5:
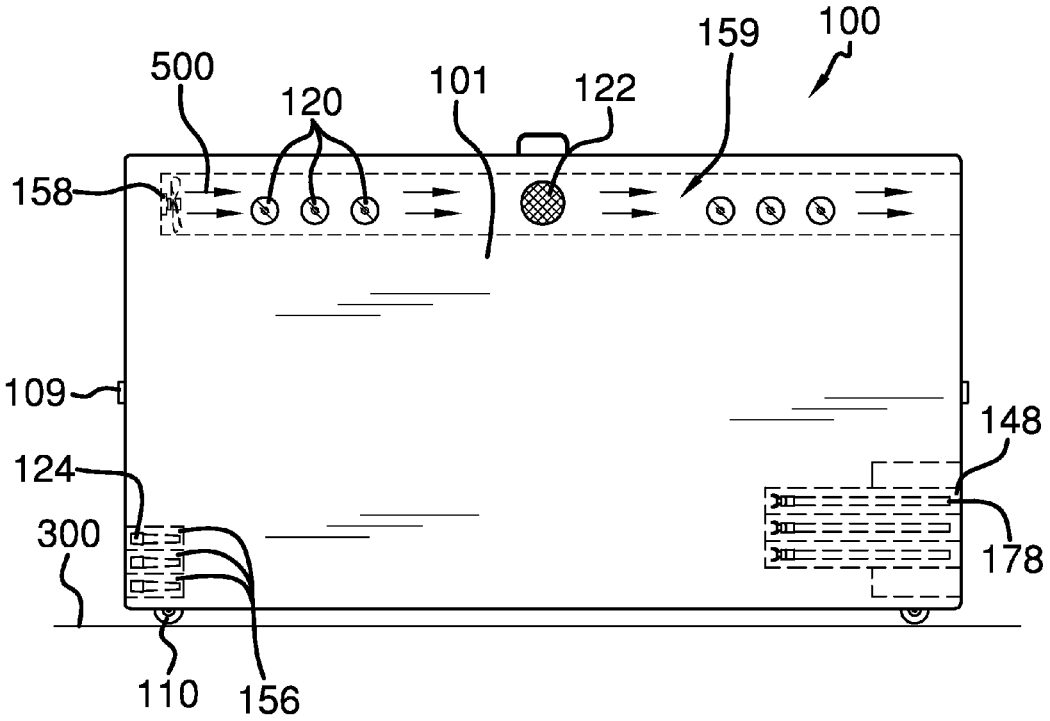
FIG. 5 is a top view of an embodiment of the disclosure.

Referring to FIG. 5, the invention 100 includes a cooling fan 158 that is located inside of a cooling fan duct 159. The cooling fan duct 159 is provided underneath the top surface 101. Moreover, the cooling fan duct 159 enables air 500 to be moved via the cooling fan 158, and across the plurality of light members 120 in order to remove excess heat therefrom. The cooling fan duct 159 exhausts from a duct port 160 located on the fourth side surface 105.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A home entertainment stage comprising:

a top surface affixed onto a first side surface, a second side surface, a third side surface, and a fourth side surface;

a bottom surface includes a plurality of feet that are configured to interface with a ground surface;

said bottom surface is opposite of the top surface;

wherein a plurality of light members, a fan, and a plurality of speakers are all built into the home entertainment stage;

wherein the top surface is configured to support at least one person thereon such that the home entertainment stage provides a miniature platform with which to deliver a performance there from;

wherein the second side surface, the first side surface, and the fourth side surface each include a handle member; whereas, the third surface includes a plurality of wheels thereon; wherein the handle members and the plurality of wheels enable the home entertainment stage to be turned 90 degrees over to the side in order to wheel the home entertainment stage away when not in use wherein the home entertainment stage includes the plurality of light members, a plurality of speakers, a blower, a plurality of microphone stands and a plurality of microphones; and wherein the light members are provided on the top surface; wherein the plurality of speakers are located on the first side surface, the second side surface, and the fourth side surface; wherein the blower is located on the top surface in order to provide moving air for said person standing thereon; wherein the plurality of microphone stands and the respective microphones are placed onto the top surface.

2. The home entertainment stage according to claim 1 wherein the top surface is generally rectangular in shape.

3. The home entertainment stage according to claim 2 wherein the first side surface, the second side surface, the third side surface, and the fourth side surface all have a side height, which is no less than 3 inches, but not more than 2 feet.

4. The home entertainment stage according to claim 3 wherein the top surface is further defined with a top surface width, which is not less than 2 feet, but not more than 6 feet.

5. The home entertainment stage according to claim 4 wherein the top surface is further defined with a top surface length, which is not less than 4 feet, but not more than 10 feet; wherein a bottom surface includes a plurality of feet member thereon; said feet member interface between the bottom surface and a ground surface.

6. The home entertainment stage according to claim 5 wherein the top surface, the first side surface, the second side surface, the third side surface, the fourth side surface, and the bottom surface form an interior space; wherein the interior space accommodates a plurality of components associated with the use of the home entertainment stage.

7. The home entertainment stage according to claim 1 wherein the first side surface includes at least one light access; wherein the at least one light access is an opening on the first side surface such that the plurality of light members are accessible from underneath the top surface.

8. The home entertainment stage according to claim 7 wherein the second side surface includes a plurality of microphone storage units; wherein the microphone storage units each enable one of the plurality of microphones to be stored therein; wherein the plurality of microphone storage units each include a microphone storage unit cover that encloses the plurality of microphones within the microphone storage units.

9. The home entertainment stage according to claim 8 wherein the second side surface includes a plurality of light switches, electrical outlets, and audio controls; wherein the audio controls control the output of the speakers, and are in wireless communication with the microphones; wherein the light switches control the plurality of light members; wherein the third side surface includes a cord storage cover that when removed provides access to a main electrical cord that is responsible for providing all electrical power via a standard electrical outlet.

10. The home entertainment stage according to claim 9 wherein the main electrical cord connects to the plurality of lights switches, the electrical outlets, and the audio controls, and the blower.

11. The home entertainment stage according to claim 10 wherein a microphone base storage compartment is provided on the third side surface; wherein the plurality of microphone stands is each able to be disassembled into a respective microphone stand base and a microphone stand pole.

12. The home entertainment stage according to claim 11 wherein the microphone stand base is able to be stored inside of the microphone base storage compartment; wherein a microphone stand pole compartment is also included, and is responsible for storing the plurality of microphone stand poles therein.

13. The home entertainment stage according to claim 12 wherein a cooling fan that is located inside of a cooling fan duct; wherein the cooling fan duct is provided underneath the top surface.

14. The home entertainment stage according to claim 13 wherein the cooling fan duct enables air to be moved via the cooling fan, and across the plurality of light members in order to remove excess heat therefrom.

15. The home entertainment stage according to claim 14 wherein the cooling fan duct exhausts from a duct port located on the fourth side surface.

* * * * *